United States Patent [19]

Desaules

[11] 4,039,076

[45] Aug. 2, 1977

[54] PACKAGING AND DISPLAY ARRANGEMENT FOR CHEMICALS

[75] Inventor: Jean-Jacques Desaules, Les Brenets, Switzerland

[73] Assignee: Fabrique d'Horlogerie Chms. Tissot et Fils S.A., Le Locle, Switzerland

[21] Appl. No.: 659,055

[22] Filed: Feb. 26, 1976

[51] Int. Cl.[2] ..... B65D 81/32

[52] U.S. Cl. ..... 206/219; 206/229; 206/466

[58] Field of Search ..... 206/219, 221, 223, 229, 206/484, 466; 221/94, 191, 192

[56] References Cited

U.S. PATENT DOCUMENTS

| | | | |
|---|---|---|---|
| 2,756,874 | 7/1956 | Erickson et al. | 206/221 |
| 3,082,867 | 3/1963 | Gelpey | 206/221 |
| 3,491,875 | 1/1970 | Fischer | 206/229 |
| 3,782,600 | 1/1974 | Columbus | 222/94 |

*Primary Examiner*—William T. Dixson, Jr.
*Attorney, Agent, or Firm*—Griffin, Branigan and Butler

[57] ABSTRACT

The invention concerns a packaging and display arrangement of a well-known type in which a flexible plastic film container is used to store premeasured amounts of two chemical substances such as for instance a glue and a catalyst and in which separation of the two components prior to use is obtained by means of a member which is applied externally to the container and which is received within a channel portion of a supporting base. Another portion of the base is arranged to form a mixing trough for the components once they have been brought together and one portion of the member may likewise serve as an applying spatula.

5 Claims, 9 Drawing Figures

FIG. 1.
FIG. 1a.
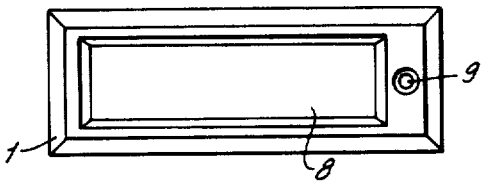
FIG. 1c.
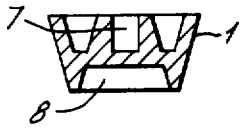
FIG. 1b.
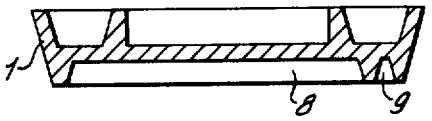
FIG. 2.
FIG. 2a.
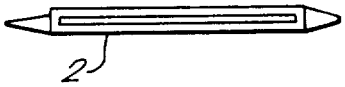
FIG. 2b.
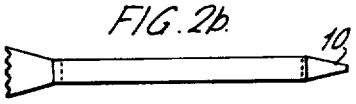
FIG. 3.
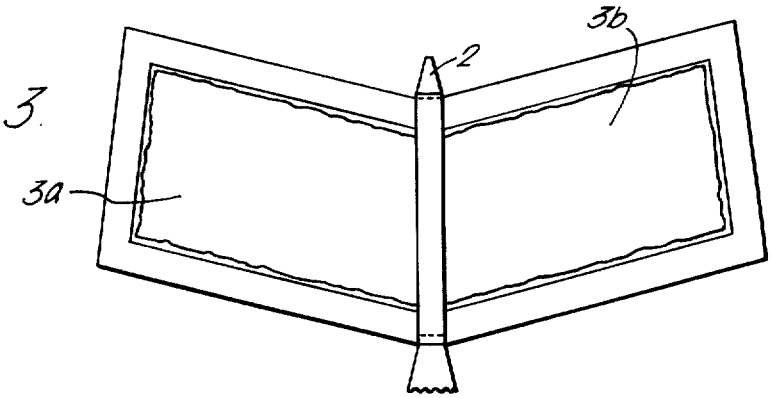
FIG. 4.
FIG. 4a.
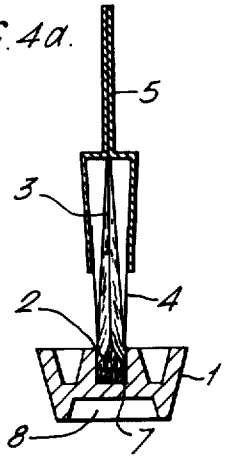
FIG. 4b.
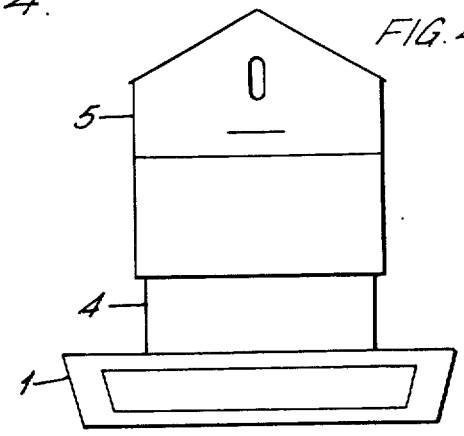

PACKAGING AND DISPLAY ARRANGEMENT FOR CHEMICALS

BACKGROUND OF THE INVENTION

It has long been known to make use of flexible packages for storing components which prior to use must be kept isolated and which immediately prior to use are brought together, such for example may include a liquid polymerizable resinous material and a catalytic agent. Normally, such chemical ingredients are premeasured prior to introduction into the package which may thereafter be sealed. When it is desired to use the composition the seal may be broken to enable the mixing of the two ingredients and thereafter the package is opened for application of the contents thereof. For various examples of this type of arrangement reference may be had for example to: U.S. Pat. Nos. 2,756,874; 3,809,224; 3,523,607; 3,082,867 and 3,741,381.

The present invention conserves the basic features as shown in many of these prior art patents and adds thereto a novel packaging arrangement which is considered suitable for display at retail counters where the product mauy attract the notice of the public. In particular, the invention adapts the clamping divider member as found in most examples of the prior art so that this latter fulfills plural functions and as well provides an attractive display arrangement.

SUMMARY OF THE INVENTION

The invention thus provides a packaging and display arrangement for chemicals which must be stored in isolation from one another but which are mixed together immediately prior to use comprising a sealed container in the form of a flattened tube of flexible plastic film, a dividing member removably applied externally to said container so that first and second compartments are obtained within said container for the storage of first and second chemical constituents, a base member having a retaining channel adapted to receive and hold said dividing member and the portion of the container to which said dividing member is applied, said dividing member comprising a mixing and applying spatula and said base member further comprising a mixing trough.

BRIEF DESCRIPTION OF THE DRAWINGS

FIG. 1 shows the base member and FIG. 1*a*, 1*b*, 1*c* respectively show a plan view, a sectional elevation and an end sectional view of this base member.

FIG. 2 shows the dividing-spatula member in which FIG. 2*a* and 2*b* respectively represent an elevation and a plan.

FIG. 3 is a perspective view of the package arrangement including the dividing-spatula member applied thereto prior to placing within the base member and final sealing thereof.

FIG. 4*a* is an end section of the completed assembly.

FIG 4*b* is a side elevation of the completed assembly.

DETAILED DESCRIPTION

In FIG. 1 is shown the base member which provides the basically novel features of the present invention. Base member 1 as shown in detail in FIGS. 1*a*, 1*b* and 1*c* comprises a trough member having a basically trapezoidal form when viewed in end elevation or side elevation and may be obtained for example by injection molding of a suitable plastic material. As most clearly seen in FIG. 1*c* a central grove portion 7 serves as a retaining clamp for the packaging arrangement subsequently to be described. Also clearly visible in FIG. 1*a*, 1*b* and 1*c* is trough portion 8 which may be obtained during the injection step of manufacture and which serves as a mixing arrangement for the chemical to be applied, 9 represents a depression also formed at the time of manufacture of the base member 1 and this may cooperate with a pointed end 10 of the dividing-spatula as shown in FIG. 2 to pierce the package once mixing has been completed. The other end of the dividing-spatula serves as an applicator for the material following mixing. The central portion 2 of the dividing spatula, as will be subsequently observed, serves to divide the package and at the same time to retain said package within the base member 1.

FIG. 3 shows in perspective a view of the package prior to final assembly, 3*a* indicating one portion of the compartment and 3*b* the other portion. Basically the package comprises a container made of a flexible plastic material which is sealed around the edges but which may be left open at the ends prior to filling. A typical procedure in obtaining such a packaging arrangement is to form a container by folding over a thin plastic film and sealing this along one edge thereof to provide a flattened flexible tube. The tube is thereafter folded about the dividing-spatula member 2 thereby separating it into two compartments, the chemicals being introduced separately into each compartment and the ends being thereafter sealed. The choice of plastic as far as forming the container is concerned will be of course determined by the nature of the chemicals which are intended to be stored therein.

As shown in FIG. 4*a* the container including the dividing-spatula may be next provided with paper wrapper 4 and an outer suspending wrapper 5. This entire combination may then be introduced into the grove 7 on the base member 1. At this point the arrangement is complete.

For the user it is clear that he need only remove the dividing-spatula and the package arrangement from the groove 7 thereafter removing the cover papers 4 and 5 and by kneading the package following unfolding thereof from the dividing-spatula 2 the contents will be mixed. The filling of the package will of course have been done using premeasured quantities so that there is no need for the user to pay any particular attention in this respect. Once the user is satisfied that mixing has been satisfactorily carried out he may then utilize the pointed end 10 of the dividing-spatula to pierce a portion of the plastic container 3 and the contents now thoroughly mixed may be introduced into the trough 8. It will be clear that from the form given to the base member this will be relatively stable and the trough 8 will serve to contain the now mixed chemicals for easy application thereof through use of the spatula 2.

I claim:

1. A packaging and display arrangement for chemicals which must be stored in isolation from one another but which are mixed together immediately prior to use, said packaging and display arrangement comprising, in combination:

a mixing and applying spatula;

a base member having a retaining channel and a mixing trough therein;

a sealed container comprising a flattened tube of flexible plastic film;

said flattened tube having an intermediate portion disposed in said retaining channel;

said spatula being removably disposed in said retaining channel and having a body configuration for pressing said intermediate portion of said flattened tube against said retaining channel to effectively divide said flattened tube into two compartments for holding said chemicals in isolation from one another.

2. A packaging and display arrangement as claimed in claim 1 and further comprising:

flexible wrapper means enclosing said spatula and said sealed container and having a generally flattened suspending portion;

said flexible wrapper means extending between said intermediate portion of said flattened tube and the wall of said retaining channel whereby said spatula, said sealed container, and said base member may all be suspended by said wrapper means.

3. Packaging and display arrangement as set forth in claim 1 wherein said base member further includes a depression adapted to cooperate with an end of the spatula so as to be able to pierce the container.

4. Packaging and display arrangement as set forth in claim 1 wherein said base member is formed by molding of a plastic material.

5. Packaging and display arrangement as set forth in claim 1 wherein said chemicals comprise a synthetic adhesive and a catalyst.

* * * * *